US005888358A

United States Patent [19]

Kihara et al.

[11] Patent Number: 5,888,358

[45] Date of Patent: Mar. 30, 1999

[54] ELECTRICALLY DEPOSITING DRUM

[75] Inventors: Mitsuo Kihara; Kanenobu Adachi, both of Joetsu, Japan

[73] Assignee: Nippon Stainless Steel Kozai Co., Ltd., Niigata-ken, Japan

[21] Appl. No.: 969,358

[22] Filed: Nov. 28, 1997

[30] Foreign Application Priority Data

Dec. 4, 1996 [JP] Japan ..... 8-323925
Aug. 29, 1997 [JP] Japan ..... 9-234599

[51] Int. Cl.[6] ..... C25D 17/00

[52] U.S. Cl. ..... 204/213; 204/290 R; 204/272

[58] Field of Search ..... 204/290 R, 213, 204/208, 272; 205/240, 292

[56] References Cited

U.S. PATENT DOCUMENTS

| | | | |
|---|---|---|---|
| 4,529,486 | 7/1985 | Polan | 204/213 |
| 4,789,452 | 12/1988 | Morimoto et al. | 204/290 R |
| 5,215,646 | 6/1993 | Wolski et al. | 204/208 |
| 5,268,045 | 12/1993 | Clare | 205/272 |
| 5,628,892 | 5/1997 | Kawashima et al. | 205/292 |

*Primary Examiner*—Bruce F. Bell
*Attorney, Agent, or Firm*—Sughrue, Mion, Zinn Macpeak & Seas, PLLC

[57] ABSTRACT

An electric depositing drum is provided for a copper foil producing machine for producing copper foil. In the electrically depositing drum 3 provided with a top skin 2 on an outer circumferential surface of an outer circumferential plate 1*a* of an inner drum 1, nickel plating or brass plating is effected onto an inner circumferential surface of the top skin 2 to form a plated layer 2*m*.

9 Claims, 3 Drawing Sheets

ELECTRICALLY DEPOSITING DRUM

BACKGROUND OF THE INVENTION

The present invention relates to an electrically depositing drum in a copper foil producing machine for producing copper foil.

Many approaches and improvements have conventionally been made for electrically depositing and forming copper foil having a uniform thickness and a uniform smooth surface on a surface of an electrically depositing drum. In particular, conductivity of the top skin and conductivity and anti-corrosion property of outer circumferential plates of the top skin and an inner drum are improved to make it possible to produce excellent copper foil.

The anti-corrosion problem has recently been solved to some extent by the following steps. Namely, a titanium plate that is superior in anti-corrosion property to electrolyte is used as a top skin. This top skin is bonded on the surface of the inner drum. A titanium electrically depositing drum for forming copper foil having a uniform thickness and a uniform smooth surface on the outer circumferential surface of the titanium plate is used.

In this titanium electrically depositing drum, in general, the titanium plate is bonded on an outer circumferential portion of the inner drum made of soft steel or stainless steel. The copper foil is produced on the outer circumferential surface of the titanium plate by causing current to flow from the titanium plate to the inner drum through the outer circumferential portion. However, the conventional titanium electrically depositing drum suffers from the following problems concerning the conductivity.

i) Unless the contact and intimate bond between the titanium plate and the inner drum are sufficient, a local electric supply trouble occurs.

ii) As the inner drum is gradually corroded by the electrolyte, oxidized scales are formed on the inner drum. For this reason, the conductivity is locally deteriorated.

iii) In the case where the inner drum is made of iron system material, even if an expensive top skin like titanium is coated, when rust is generated on the inner drum, the conductivity of the titanium top skin is deteriorated to thereby offset the superiority of the titanium.

Accordingly, owing to the above-described problems concerning the conductivity, in the conventional titanium electrically depositing drum, there is a fear that a color change caused by the non-uniformity of the thickness of the copper foil, the abnormal precipitation, local heat, i.e., a so-called hot spot would occur. In order to enhance the productivity and the quality of the product, it is necessary to improve the conductivity.

SUMMARY OF THE INVENTION

In order to overcome the foregoing defects, in view of the fact that it is possible to improve the conductivity without any consideration of the conductivity of the titanium plate per se by improving the conductivity on the inner drum side and performing the prevention of degradation of the conductivity and in view of the fact that the contact property and bonding property between the titanium plate and the inner drum are improved so that copper foil having a uniform thickness without any color change and having a uniform smooth surface in conformity with the target without any trouble, an object of the present invention is to provide an electrically depositing drum having excellent conductivity by such an approach that brass plating or nickel plating is effected on a surface of the inner drum or on the inside of the titanium plate to produce the plated titanium electrically depositing drum on trial, and tests are repeated as to the conductivity, the bonding property, the contact property, the plating property, the heat resistance and acid resistance or the like of the plated layer.

Also, in the case where the inner drum is made of, for example, iron based material, if rust is generated in the inner drum, the conductivity of the titanium top skin is deteriorated.

This also applies in the case where the top skin is made of iron based material. If the rust is generated in the top skin, although it is possible to again make the smooth surface on the outer circumferential surface of the top skin by polishing the outer circumferential surface of the top skin, it is impossible to polish the inner circumferential surface of the top skin unless the electrically depositing drum is dismounted. Thus, the inner circumferential surface of the top skin would be corrugated by the rust. The bonding property between the top skin and the inner drum is degraded, resulting in poor conductivity together with the rust.

In order to solve also this problem, according to the present invention, another object of the present invention is to provide an electrically depositing drum that may exhibit sufficient practical usage, in which tin plating or soldering alloy plating that is inferior in the maintenance of the conductivity to the nickel plating or the brass plating but superior in the contact property or the plating property is applied to the surface of the inner drum or the inside of the titanium plate to prevent the generation of the rust as a result of which the degradation of conductivity of the top skin is prevented.

DETAILED DESCRIPTION OF THE INVENTION

The essential points of the present invention will now be described with reference to the accompanied drawings.

According to a first aspect of the invention, there is provided an electrically depositing drum 3 provided with a top skin 2 on an outer circumferential surface of an outer circumferential plate 1*a* of an inner drum 1 is characterized in that nickel plating or brass plating is effected onto an inner circumferential surface of the top skin 2 to form a plated layer 2*m*.

According to a second aspect of the invention, there is provided an electrically depositing drum 3 provided with the top skin 2 on the outer circumferential surface of the outer circumferential plate 1*a* of the inner drum 1 is characterized in that nickel plating or brass plating is effected onto an outer circumferential plate 1*a* of the inner drum 1 to form a plated layer 1*m*.

According to a third aspect of the invention, there is provided an electrically depositing drum 3 provided with the top skin 2 on the outer circumferential surface of the outer circumferential plate 1*a* of the inner drum 1 is characterized in that nickel plating or brass plating is effected onto an inner circumferential surface of the top skin 2 to form a plated layer 2*m*, and nickel plating or brass plating is effected onto an outer circumferential surface of the outer circumferential plate 1*a* of the inner drum 1 to form a plated layer 1*m*.

According to a fourth aspect of the invention, there is provided an electrically depositing drum 3 provided with the top skin 2 on the outer circumferential surface of the outer circumferential plate 1*a* of the inner drum 1 is characterized in that tin plating or soldering alloy plating is effected onto an inner circumferential surface of the top skin 2 to form a plated layer 2*m*.

According to a fifth aspect of the invention, there is provided an electrically depositing drum 3 provided with the top skin 2 on the outer circumferential surface of the outer circumferential plate 1*a* of the inner drum 1 is characterized in that tin plating or soldering alloy plating is effected onto an outer circumferential surface of the outer circumferential plate 1*a* of the inner drum 1 to form a plated layer 1*m*.

According to a sixth aspect of the invention, there is provided an electrically depositing drum 3 provided with the top skin 2 on the outer circumferential surface of the outer circumferential plate 1*a* of the inner drum 1 is characterized in that tin plating or soldering alloy plating is effected onto an inner circumferential surface of the top skin 2 to form a plated layer 2*m* and tin plating or soldering alloy plating is effected onto an outer circumferential surface of the outer circumferential plate 1*a* of the inner drum 1 to form a plated layer 1*m*.

According to a seventh aspect of the invention, there is provided an electrically depositing drum 3 provided with the top skin 2 on the outer circumferential surface of the outer circumferential plate 1*a* of the inner drum 1 is characterized in that nickel plating or brass plating is effected onto an inner circumferential surface of the top skin 2 to form a plated layer 2*m* and tin plating or soldering alloy plating is effected onto an outer circumferential surface of the outer circumferential plate 1*a* of the inner drum 1 to form a plated layer 1*m*.

According to an eighth aspect of the invention, there is provided an electrically depositing drum 3 provided with the top skin 2 on the outer circumferential surface of the outer circumferential plate 1*a* of the inner drum 1 is characterized in that the inner drum 1 is made of iron based material, also, the top skin 2 is made of titanium, nickel plating or brass plating is effected onto an inner circumferential surface of the top skin 2 to form a plated layer 2*m*, and tin plating or soldering alloy plating is effected onto an outer circumferential surface of the outer circumferential plate 1*a* of the inner drum 1 to form a plated layer 1*m*.

According to a ninth aspect of the invention, there is provided an electrically depositing drum 3 provided with the top skin 2 on the outer circumferential surface of the outer circumferential plate 1*a* of the inner drum 1 is characterized in that tin plating or soldering alloy plating is effected onto an inner circumferential surface of the top skin 2 to form a plated layer 2*m*, and nickel plating or brass plating is effected onto an outer circumferential surface of the outer circumferential plate 1*a* of the inner drum 1 to form a plated layer 1*m*.

EFFECT AND ADVANTAGE OF THE INVENTION

First Aspect of Invention

The nickel plating or brass plating is effected on the inner circumferential surface of the top skin 2 to form the plated layer 2*m*. Accordingly, the plated layer 2*m* is more intimately bonded with the top skin 2 in comparison with the electrically depositing drum simply having a liner such as a copper plate or brass plate on the inner circumferential surface of the top skin 2. As a result, the contact property and the bonding property between the top skin 2 and the inner drum 1 are inevitably improved.

Also, the electric resistance ratios are as follows. (The tin and soldering alloy platings are also enumerated in the following comparison tables for the purpose of comparison with aspects in which the tin plating or the soldering alloy plating is adopted.)

| | | |
|---|---|---|
| titanium | 55 | (20° C. μΩ cm) |
| stainless steel | 72 | (20° C. μΩ cm) |
| iron (metal skin) | 9.7 | (20° C. μΩ cm) |
| iron (with oxidized rust) | 100 or more | (20° C. μΩ cm) |
| nickel | 6.8 | (20° C. μΩ cm) |
| copper | 1.7 | (20° C. μΩ cm) |
| brass | 3.6 | (20° C. μΩ cm) |
| tin | 12.8 | (20° C. μΩ cm) |
| soldering alloy | 17.2 | (20° C. μΩ cm) |

As described above, the nickel plating or brass plating is several times to several tens of times better in conductivity than the titanium frequently used as the top skin 2. Accordingly, the nickel plating or brass plating considerably enhances the conductivity of the top skin 2. In addition, the plating is coated on the inner circumferential surface of the top skin 2 as the plated layer 2*m*. It is therefore possible to intimately bond the top skin 2 to the inner drum 1 in a very good condition.

Also, as described below, since the nickel plating or brass plating is superior in the anti-corrosion property, heat resistance and anti-oxidization, it is effective to prevent the production of the dielectric coating film caused by the dielectric coating film and high temperature oxidization due to the corrosion. As a result, the surface electric resistance is not increased. Namely, by applying the nickel plating or brass plating, it is possible to prevent the degradation of the conductivity and to select inexpensive inner drum material.

If the electric resistance comparative value of the copper material (fresh surface) is regarded as one:

<surface electric resistance comparison values in corrosive atmosphere>

Measurement after long time exposure in test corrosive atmosphere (sulfate mist+high humidity)

| | | | |
|---|---|---|---|
| titanium material | 1.1 | (20° C.) | |
| iron material | 517 | (20° C.) | thickness decrease by corrosion |
| copper material | 1.3 | (20° C.) | thickness decrease by corrosion |
| brass material | 1.1 | (20° C.) | |
| nickel plating on the above materials | 1.1–1.2 | (20° C.) | |
| brass plating on the above materials | 1.1 | (20° C.) | |
| tin plating on the above materials | 9–10 | (20° C.) | |

<surface electric resistance comparison values in high temperature oxidizing atmosphere>

Measurement after long time heating in test high temperature oxidizing atmosphere (in view of temperature rise on process and operation)

<heating 100° C., after cooling>

| | | | |
|---|---|---|---|
| titanium material | 1.3 | (20° C.) | |
| iron material | 1.2 | (20° C.) | |
| copper material | 8.6 | (20° C.) | oxidized coat generated |
| brass material | 1.1 | (20° C.) | |
| nickel plating on the above materials | 1.1–1.2 | (20° C.) | |

-continued

| | | | |
|---|---|---|---|
| brass plating on the above materials | 1.1 | (20° C.) | |
| tin plating on the above materials | 1.2 | (20° C.) | |

<heating 300° C., after cooling>

| | | | |
|---|---|---|---|
| titanium material | 1.4 | (20° C.) | oxidized coat generated |
| iron material | 1.3 | (20° C.) | |
| copper material | 345 | (20° C.) | oxidized coat increased |
| brass material | 1.1 | (20° C.) | |
| nickel plating on the above materials | 1.1–1.2 | (20° C.) | |
| brass plating on the above materials | 1.1–1.2 | (20° C.) | |
| tin plating on the above materials | 1.2–1.3 | (20° C.) | |

With the synergic effects, the copper foil produced on the surface of the top skin 2 becomes the foil having the uniform thickness and having the uniform smooth surface in the overall range. In addition, the local electric resistance heat that causes the trouble in production of the copper foil may be avoided generating. It is possible to produce the electrically depositing drum which is superior in practical use and productivity, in which the copper foil having a high quality may always be formed on the surface of the top skin 2.

Second Aspect of Invention

Instead of the application of the plated layer 2*m* on the inner circumferential surface of the top skin 2 in accordance with the first aspect of the invention, the plated layer 1*m* is applied to the outer circumferential surface of the outer circumferential plate 1*a* of the inner drum 1, and the top skin 2 is coated intimately on the inner drum 1. Accordingly, it is the same effect as the lining of the plated layer 1*m* on the inner circumferential surface of the top skin 2. Thus, it is possible to produce the electrically depositing drum having the same effect as that of the first aspect.

Third Aspect of Invention

Since the first and second aspects of the invention are combined in accordance with a third aspect of the invention, the drum is much superior in conductivity, bonding property between the plated layer 2*m* and the plated layer 1*m* and to the inner circumferential surface of the top skin 2, and bonding property to the outer circumferential plate 1*a* of the inner drum 1 by the doubled plated layers 2*m* and doubled plated layers 1*m*. It is possible to obtain the electrically depositing drum for producing the copper foil that is superior in the practical use.

Fourth Aspect of Invention

Since the plated layer 2*m* according to the first aspect of the invention is changed to the tin plating or soldering alloy plating, although the fourth aspect is inferior in conductivity to the other aspects, it is superior in contact property or plating property to the other aspects to thereby positively prevent the generation of rust. As a result, the degradation of the conductivity of the top skin 2 is prevented, and the copper foil having a high quality may be formed on the surface of the top skin 2. It is possible to produce the electrically depositing drum that is excellent in practical use and productivity.

Incidentally, even if the outer circumferential surface of the top skin 2 is rusted, it is possible to remove the rust by polishing the outer circumferential surface. It is therefore possible to produce the excellent quality copper foil on the surface of the top skin 2.

Fifth Aspect of Invention

Instead of the application of the plated layer 2*m* on the inner circumferential surface of the top skin 2 in accordance with the fourth aspect of the invention, the plated layer 1*m* is applied to the outer circumferential surface of the outer circumferential plate 1*a* of the inner drum 1, and the top skin 2 is intimately bonded to the inner drum 1. Accordingly, it is the same effect as the lining of the plated layer 1*m* on the inner circumferential surface of the top skin 2. Thus, it is possible to produce the electrically depositing drum having the same effect as that of the fourth aspect.

Sixth Aspect of Invention

Since the fourth and fifth aspects of the invention are combined in accordance with a sixth aspect of the invention, the drum is much superior in conductivity, bonding property between the plated layer 2*m* and the plated layer 1*m* and to the inner circumferential surface of the top skin 2, and bonding property to the outer circumferential plate 1*a* of the inner drum 1 by the doubled plated layers 2*m* and doubled plated layers 1*m*. Even if the top skin 2 or the inner drum 1 is made of material that is less expensive but might be rusted, it is possible to prevent the generation of rust without fail. It is possible to produce the electrically depositing drum 3 of the less expensive material such as soft iron. It is possible to obtain the electrically depositing drum for producing the copper foil that is superior in the practical use.

Seventh Aspect of Invention

Since the nickel plating or the brass plating is applied to the inner circumferential surface of the top skin 2 to form the plated layer 2*m* in the same manner as in the first aspect, the plated layer 2*m* is well intimately bonded to the top skin 2 in comparison with the electrically depositing drum in which the copper plate or the brass plate is internally lined to the inner circumferential surface of the top skin 2. As a result, the contact property and the bonding property between the top skin 2 and the inner drum 1 become better.

Also, the conductivity of the nickel plating or the brass plating is several times to several tens of times higher than that of the titanium that is used as the top skin 2 in many cases. Thus, the conductivity of the top skin made of titanium or the like is remarkably enhanced.

Also, the nickel plating or the brass plating has an effect to prevent the generation of the dielectric coating film due to the dielectric coating film and high temperature oxidation caused by the corrosion since the nickel plating or brass plating has high anti-corrosion property and high temperature resistance/oxidation resistance. As a result, the surface electric resistance is not increased. Namely, by the application of the nickel plating or the brass plating, the degradation of the conductivity is prevented and the selection of the less expensive inner drum material is possible.

Also, since the tin plating or soldering alloy plating is applied to the outer circumferential surface of the outer circumferential plate 1*a* of the inner drum 1 in the same manner as in the fifth aspect of the invention to form the plated layer 1*m*, although the seventh aspect is inferior in conductivity to the other aspects, it is superior in contact property or plating property to the other aspects to thereby positively prevent the generation of rust. As a result, the degradation of the conductivity of the top skin 2 is prevented, and the copper foil having a high quality may be formed on the surface of the top skin 2. It is possible to produce the electrically depositing drum that is excellent in practical use and productivity.

Also, in the case where the top skin 2 is made of the material like titanium that would not be rusted and the inner drum 1 is made of the material such as soft iron that is less expensive but might be rusted, the plated layer 1*m* positively prevents the generation of the rust of the inner drum 1. In particular, the seventh aspect has a high effect with this structure.

Eighth Aspect of Invention

This aspect relates to the structure in which the inner drum 1 is made of iron based material and the top skin 2 is made of titanium in the seventh aspect of the invention. Accordingly, the top skin 2 which is resistive against the rust and should be superior in conductivity is more better in conductivity. Also, the inner drum 1 that has no problem in conductivity and that is likely to be rusted is not rusted. In this case, the advantage of the seventh aspect is well exhibited particularly.

Ninth Aspect of Invention

Since the plated layer 2*m* is tin plated or soldering-alloy plated in the same manner as in the fourth aspect of the invention, although the ninth aspect is inferior in conductivity to the nickel plating or brass plating, it is superior in contact property or plating property to thereby positively prevent the generation of rust. As a result, the degradation of the conductivity of the top skin 2 is prevented, and the copper foil having a high quality may be formed on the surface of the top skin 2. It is possible to produce the electrically depositing drum that is excellent in practical use and productivity.

Incidentally, even if the outer circumferential surface of the top skin 2 is rusted, it is possible to remove the rust by polishing the outer circumferential surface. It is therefore possible to produce the excellent quality copper foil on the surface of the top skin 2.

Instead of the application of the plated layer 2*m* on the inner circumferential surface of the top skin 2 in the same manner as in the second aspect of the invention, the plated layer 1*m* is applied to the outer circumferential surface of the outer circumferential plate 1*a* of the inner drum 1 and the top skin 2 is intimately bonded to the inner drum 1. Accordingly, it is the same as the case where the plated layer 1*m* is internally lined to the inner circumferential surface of the top skin 2. Thus, it is possible to produce the electrically depositing drum having the same effect as that of the first aspect.

DESCRIPTION OF THE PREFERRED EMBODIMENTS

Eight specific embodiments of the invention will now be described with reference to the accompanying drawings.

Figure 2:
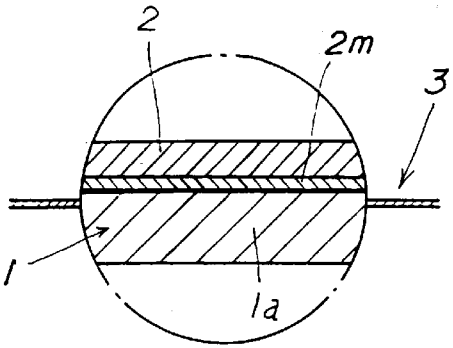
FIG. 2 is an enlarged cross-sectional view showing first and fourth embodiments.

In accordance with a first embodiment shown in FIG. 2, in an electrically depositing drum 3 provided with a top skin 2 on an outer circumferential surface of an outer circumferential plate 1*a* of an inner drum 1, nickel plating or brass plating is effected onto an inner circumferential surface of the top skin 2 to form a plated layer 2*m*.

The thus constructed first embodiment has substantially the same advantage and effect as those of the first aspect of the invention.

Figure 3:
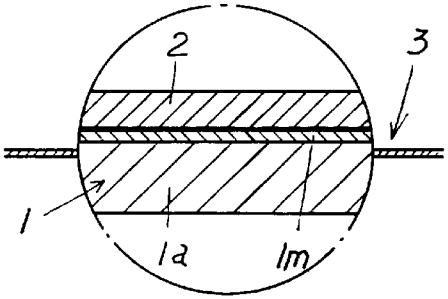
FIG. 3 is an enlarged cross-sectional view showing second and fifth embodiments.

In accordance with a second embodiment shown in FIG. 3, in the electrically depositing drum 3 provided with the top skin 2 on the outer circumferential surface of the outer circumferential plate 1*a* of the inner drum 1, nickel plating or brass plating is effected onto the outer circumferential plate 1*a* of the inner drum 1 to form a plated layer 1*m*.

The thus constructed second embodiment has substantially the same advantage and effect as those of the second aspect of the invention.

Figure 4:
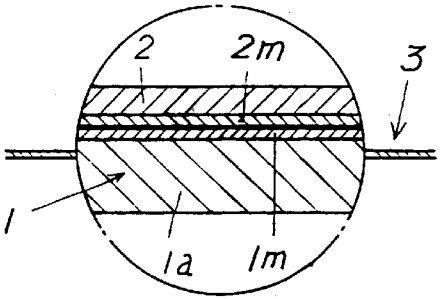
FIG. 4 is an enlarged cross-sectional view showing third, sixth, seventh and eighth embodiments.

In accordance with a third embodiment shown in FIG. 4, in the electrically depositing drum 3 provided with the top skin 2 on the outer circumferential surface of the outer circumferential plate 1*a* of the inner drum 1, nickel plating or brass plating is effected onto an inner circumferential surface of the top skin 2 to form a plated layer 2*m*, and nickel plating or brass plating is effected onto the outer circumferential surface of the outer circumferential plate 1*a* of the inner drum 1 to form a lated layer 1*m*.

The thus constructed third embodiment has substantially the same advantage and effect as those of the third aspect of the invention.

In accordance with a fourth embodiment, of the first embodiment shown in FIG. 2, instead of applying the nickel plating or brass plating on the inner circumferential surface of the top skin 2, tin plating or soldering alloy plating is effected onto an inner circumferential surface of the top skin 2 to form a plated layer 2*m*. Incidentally, the soldering alloy is a lead-tin alloy.

The thus constructed fourth embodiment has substantially the same advantage and effect as those of the fourth aspect of the invention.

Incidentally, in the case where the material that would be rusted like the soft iron is used for the top skin 2, the outer surface of the top skin 2 would be rusted. However, it is possible to easily remove the rust by polishing the outer surface of the top skin 2 by a grinder or the like. Accordingly, it is unnecessary to prevent the generation of the rust to the extent for the inner circumferential surface of the top skin 2. Also, in the case where the material that would not be rusted like the titanium is used as the top skin 2, the bonding property between the top skin 2 and the inner drum 1 is enhanced.

In accordance with a fifth embodiment, of the second embodiment shown in FIG. 3, instead of applying the nickel plating or brass plating on the outer circumferential surface of outer circumferential plate 1*a* of the inner drum 1, tin plating or soldering alloy plating is effected onto the outer circumferential surface of the outer circumferential plate 1*a* of the inner drum 1 to form a plated layer 1*m*.

The thus constructed fifth embodiment has substantially the same advantage and effect as those of the fifth aspect of the invention.

In accordance with a sixth embodiment, of the third embodiment shown in FIG. 4, instead of applying the nickel plating or brass plating on the inner circumferential surface of the top skin 2 and the outer circumferential surface of the outer circumferential plate 1*a* of the inner drum 1, tin plating or soldering alloy plating is effected to form a plated layer 2*m* and tin plating or soldering alloy plating is effected to form a plated layer 1*m*.

The thus constructed sixth embodiment has substantially the same advantage and effect as those of the sixth aspect of the invention.

In accordance with a seventh embodiment, of the third embodiment shown in FIG. 4, instead of applying the nickel plating or brass plating on the outer circumferential surface of the outer circumferential plate 1*a* of the inner drum 1, tin plating or soldering alloy plating is effected to form a plated layer 1*m*.

Since the seventh embodiment is thus constructed as described above, in the same manner as in the plated layer 1*m* of the fifth embodiment, the corrosion preventing effect of the inner drum 1 is extremely enhanced. As a result, the degradation of the conductivity of the top skin 2 is prevented. Even if the copper foil is produced continuously for a long time, there is no current supply trouble, and the copper foil having a high quality may be formed well on the surface of the top skin 2. Thus, the electrically depositing drum is superior in practical use, durability and mass-production.

Incidentally, in the seventh embodiment, its advantage and effect is effectively exhibited in the electrically depositing drum in which the titanium having a high anti-corrosion property is used as the top skin 2 and the iron based material such as soft iron that is inferior in conductivity to the titanium but is less expensive is used as the inner drum 1. Thus, the top skin 2 and the inner drum 1 would be subjected to no rust and are superior in contact property and conductivity. In addition, the copper foil having a high quality may be formed on the surface of the top skin 2 in an extremely good condition. The seventh embodiment has the most excellent advantage in the embodiments of the present invention.

Also, the other effect and advantage of the seventh embodiment are the same as that of the third, fifth, sixth, seventh and eighth aspects of the invention.

In accordance with a eighth embodiment, of the sixth embodiment shown in FIG. 4, instead of applying the tin plating or soldering alloy plating on the outer circumferential surface of the outer circumferential plate 1*a* of the inner drum 1, nickel plating or brass plating is effected to form a plated layer 1*m*.

The thus constructed eighth embodiment has substantially the same advantage and effect as those of the ninth aspect of the invention.

Incidentally, in the first through eighth embodiments, it is possible to use alloy as plating metal.

Figure 1:
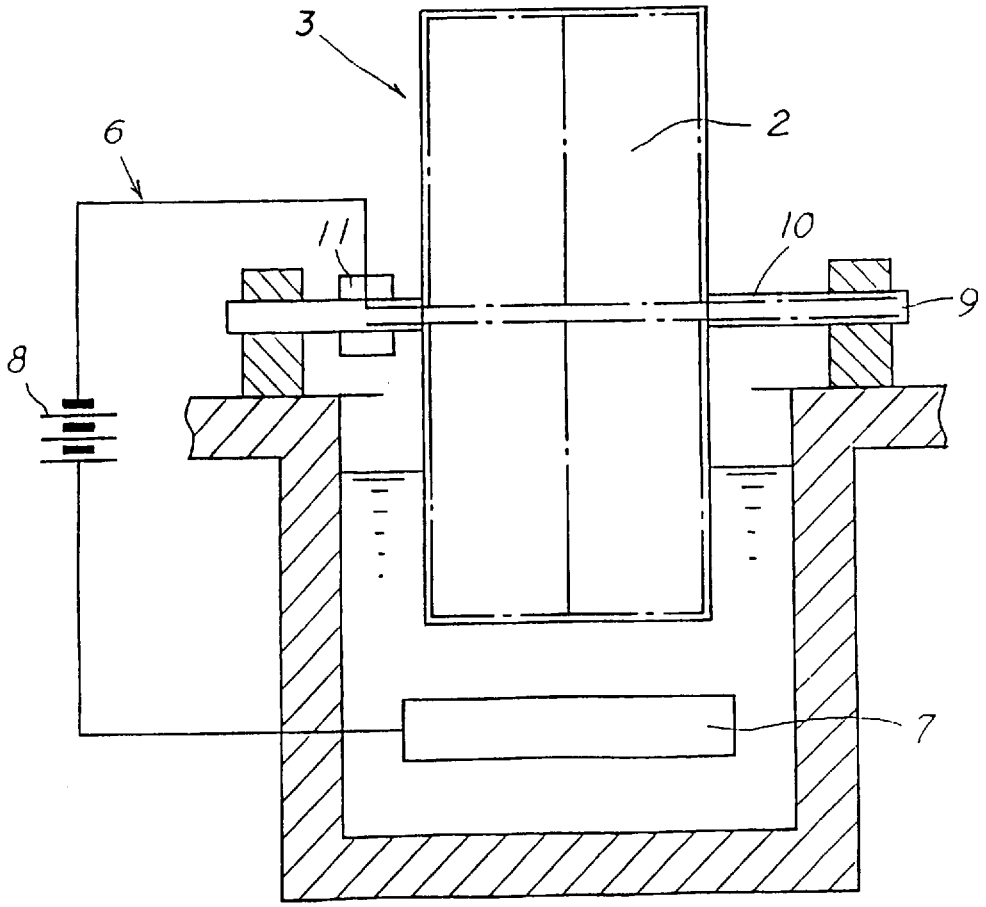
FIG. 1 is an illustration of one example of a copper foil producing machine.
Figure 5:
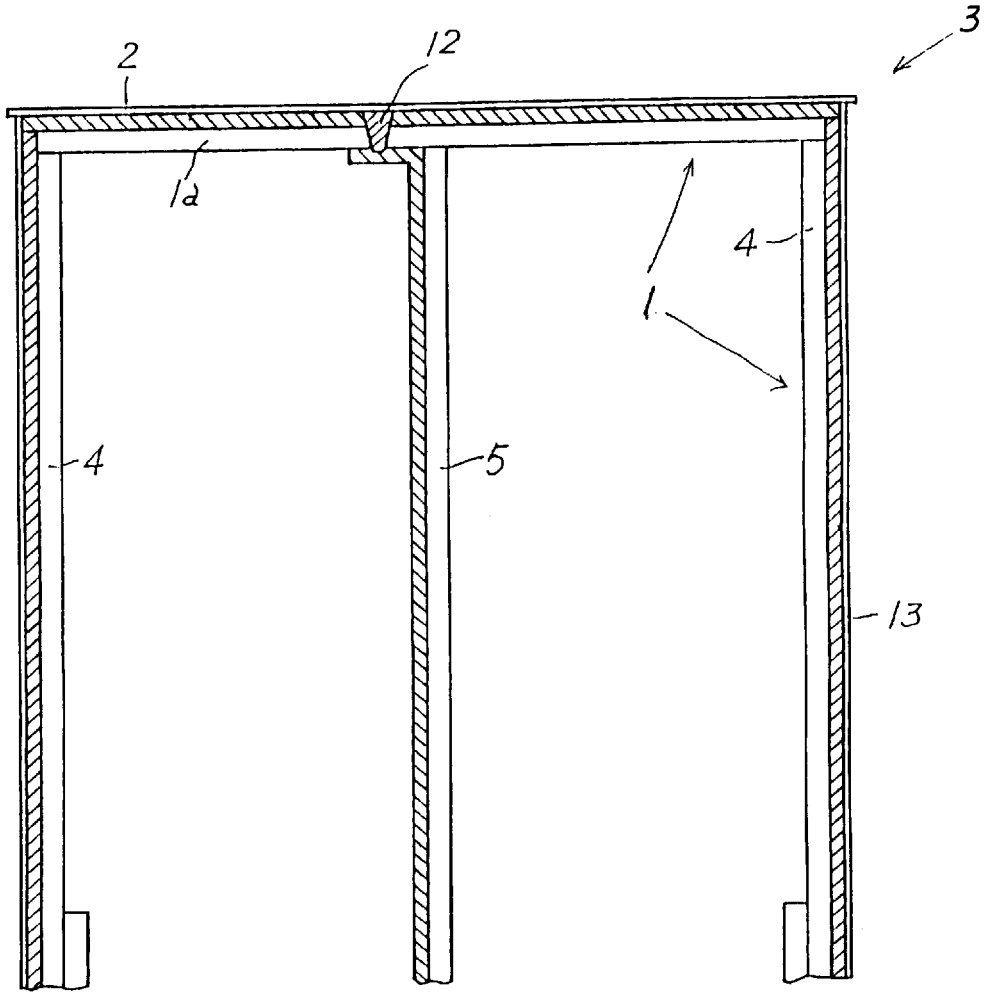
FIG. 5 is a longitudinal sectional view showing the electrically depositing drum provided at its intermediate portion with an intermediate plate while omitting hatching lines except for the copper plate.

FIG. 1 is an overall illustration of the copper foil producing machine, in which reference numeral 6 denotes an electric supply path, reference numeral 7 denotes an electrode, reference numeral 8 denotes a power source, reference numeral 9 denotes a rotary shaft, reference numeral 10 denotes a copper sleeve provided around the rotary shaft 9, and reference numeral 11 denotes an electric supply bearing. In FIG. 5, reference numeral 12 denotes a linear welding portion, and numeral 13 denotes a side titanium plate.

An example of a size of the electrically depositing drum 3 is shown as follows:

| | | |
|---|---|---|
| electrically depositing drum 3 | Ø | 2,300 mm in diameter |
| electrically depositing drum 3 | | 1,200 mm in width |
| drum outer circumferential plate 1a of stainless steel or soft iron | | 22 mm in thickness |
| titanium plate 2 | | 5 mm in thickness |
| plated layer 1m, 2m such as nickel or brass alloy | | 3–5 μm in thickness |
| side wall plate 4 made of stainless steel or soft iron | | 22 mm in thickness |
| intermediate wall plate 5 made of stainless steel or soft iron | | 22 mm in thickness |
| large diameter portion of copper sleeve 10 provided on an outer circumference of rotary shaft 9 | | 60 mm in thickness |
| side titanium plate 13 | | 4 mm in thickness |

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What we claim is:

1. An electrically depositing drum (3) provided with a top skin (2) on an outer circumferential surface of an outer circumferential plate (1*a*) of an inner drum (1), characterized in that nickel plating or brass plating is effected onto an inner circumferential surface of the top skin (2) to form a plated layer (2*m*).

2. An electrically depositing drum (3) provided with a top skin (2) on an outer circumferential surface of an outer circumferential plate (1*a*) of an inner drum (1), characterized in that nickel plating or brass plating is effected onto the outer circumferential plate 1*a* of the inner drum (1) to form a plated layer (1*m*).

3. An electrically depositing drum (3) provided with a top skin (2) on an outer circumferential surface of an outer circumferential plate (1*a*) of an inner drum (1), characterized in that nickel plating or brass plating is effected onto an inner circumferential surface of the top skin (2) to form a plated layer (2*m*), and nickel plating or brass plating is effected onto an outer circumferential surface of the outer circumferential plate (1*a*) of the inner drum (1) to form a plated layer (1*m*).

4. An electrically depositing drum (3) provided with a top skin (2) on an outer circumferential surface of an outer circumferential plate (1*a*) of the inner drum (1), characterized in that tin plating or soldering alloy plating is effected onto an inner circumferential surface of the top skin (2) to form a plated layer (2*m*).

5. An electrically depositing drum (3) provided with a top skin (2) on an outer circumferential surface of an outer circumferential plate (1*a*) of the inner drum (1), characterized in that tin plating or soldering alloy plating is effected onto an outer circumferential surface of the outer circumferential plate (1*a*) of the inner drum (1) to form a plated layer (1*m*).

6. An electrically depositing drum (3) provided with a top skin (2) on an outer circumferential surface of an outer circumferential plate (1*a*) of an inner drum (1), characterized in that tin plating or soldering alloy plating is effected onto an inner circumferential surface of the top skin (2) to form a plated layer (2*m*) and tin plating or soldering alloy plating is effected onto an outer circumferential surface of the outer circumferential plate (1*a*) of the inner drum (1) to form a plated layer (1*m*).

7. An electrically depositing drum (3) provided with a top skin (2) on an outer circumferential surface of the outer circumferential plate (1*a*) of an inner drum (1), characterized in that nickel plating or brass plating is effected onto an inner circumferential surface of the top skin (2) to form a plated layer (2*m*) and tin plating or soldering alloy plating is effected onto an outer circumferential surface of the outer circumferential plate (1*a*) of the inner drum (1) to form a plated layer (1*m*).

8. An electrically depositing drum (3) provided with a top skin (2) on an outer circumferential surface of an outer circumferential plate (1*a*) of an inner drum (1), characterized in that the inner drum (1) is made of iron based material, also, the top skin (2) is made of titanium, nickel plating or brass plating is effected onto an inner circumferential surface of the top skin (2) to form a plated layer (2*m*), and tin plating or soldering alloy plating is effected onto an outer circumferential surface of the outer circumferential plate (1*a*) of the inner drum (1) to form a plated layer (1*m*).

9. An electrically depositing drum (3) provided with an top skin (2) on an outer circumferential surface of an outer circumferential plate (1*a*) of an inner drum (1), characterized in that tin plating or soldering alloy plating is effected onto an inner circumferential surface of the top skin (2) to form a plated layer (2*m*), and nickel plating or brass plating is effected onto an outer circumferential surface of the outer circumferential plate (1*a*) of the inner drum (1) to form a plated layer (1*m*).

* * * * *

UNITED STATES PATENT AND TRADEMARK OFFICE

CERTIFICATE OF CORRECTION

PATENT NO. : 5,888,358
DATED : March 30, 1999
INVENTOR(S) : Mitsuo Kihara, et al.

It is certified that error appears in the above-identified patent and that said Letters Patent is hereby corrected as shown below:

Column 8, line 28, change "lated" to --plated--.

Signed and Sealed this

Seventh Day of September, 1999

*Attest:*

Q. TODD DICKINSON

*Attesting Officer*

*Acting Commissioner of Patents and Trademarks*